US012078026B2

(12) United States Patent
Morrison et al.

(10) Patent No.: US 12,078,026 B2
(45) Date of Patent: Sep. 3, 2024

(54) WIPER PLUG WITH DISSOLVABLE CORE

(71) Applicant: FORUM US, INC., Houston, TX (US)

(72) Inventors: Jeffery Morrison, Missouri City, TX (US); Andrew Webber, Hockley, TX (US)

(73) Assignee: FORUM US, INC., Houston, TX (US)

( * ) Notice: Subject to any disclaimer, the term of this patent is extended or adjusted under 35 U.S.C. 154(b) by 0 days.

(21) Appl. No.: 18/080,291

(22) Filed: Dec. 13, 2022

(65) Prior Publication Data

US 2024/0191596 A1 Jun. 13, 2024

(51) Int. Cl.

| | |
|---|---|
| ***E21B 34/06*** | (2006.01) |
| ***E21B 33/12*** | (2006.01) |
| *E21B 47/117* | (2012.01) |

(52) U.S. Cl.

CPC ..... *E21B 34/063* (2013.01); *E21B 33/12* (2013.01); *E21B 47/117* (2020.05); *E21B 2200/08* (2020.05)

(58) Field of Classification Search

CPC ..... E21B 33/12; E21B 34/063; E21B 47/117; E21B 2200/08

See application file for complete search history.

(56) References Cited

U.S. PATENT DOCUMENTS

| | | | |
|---|---|---|---|
| 5,479,986 A | 1/1996 | Gano et al. | |
| 5,607,017 A * | 3/1997 | Owens | E21B 33/12 166/317 |
| 6,076,600 A | 6/2000 | Vick, Jr. et al. | |
| 6,161,622 A | 12/2000 | Robb et al. | |
| 6,220,350 B1 | 4/2001 | Brothers et al. | |
| 6,431,276 B1 | 8/2002 | Robb et al. | |
| 7,353,879 B2 | 4/2008 | Todd et al. | |
| 7,703,511 B2 | 4/2010 | Buyers et al. | |
| 8,127,856 B1 | 3/2012 | Nish et al. | |
| 8,267,177 B1 | 9/2012 | Vogel et al. | |
| 8,276,670 B2 | 10/2012 | Patel | |
| 8,403,037 B2 | 3/2013 | Agrawal et al. | |
| 8,413,727 B2 | 4/2013 | Holmes | |
| 9,016,388 B2 | 4/2015 | Kellner et al. | |
| 9,062,522 B2 | 6/2015 | Frazier | |
| 9,181,772 B2 | 11/2015 | Frazier | |
| 9,267,347 B2 | 2/2016 | Agrawal et al. | |

(Continued)

FOREIGN PATENT DOCUMENTS

| | | |
|---|---|---|
| CA | 3059575 A1 | 7/2020 |
| WO | 2015073001 A1 | 5/2015 |

OTHER PUBLICATIONS

PCT International Search Report and Written Opinion dated Mar. 5, 2024, for International Application No. PCT/US2023/082884.

*Primary Examiner* — Tara Schimpf
*Assistant Examiner* — Lamia Quaim
(74) *Attorney, Agent, or Firm* — Patterson + Sheridan, LLP

(57) ABSTRACT

Aspects of the present disclosure relate to wellbore plugs, and specifically to pump down wiper plug assemblies used for conducting casing integrity pressure tests and completing wellbores. A plug assembly comprises one or more of a mandrel, a wiper, a dissolvable member, a rupture disk, and a movable sleeve. The dissolvable member and the rupture disk are configured to temporarily close fluid flow through an inner bore of the mandrel. The entire or only a portion of the outer surface of the dissolvable member comprises a protective coating.

20 Claims, 8 Drawing Sheets

(56) References Cited

U.S. PATENT DOCUMENTS

| | | | | |
|---|---|---|---|---|
| 9,441,437 | B2 | 9/2016 | Fripp et al. | |
| 9,441,446 | B2 | 9/2016 | Fripp et al. | |
| 9,611,711 | B2 | 4/2017 | Peterson et al. | |
| 9,643,250 | B2 | 5/2017 | Mazyar et al. | |
| 9,739,107 | B2 | 8/2017 | Desai et al. | |
| 9,790,762 | B2 | 10/2017 | Tolman et al. | |
| 9,833,838 | B2 | 12/2017 | Mazyar et al. | |
| 9,926,763 | B2 | 3/2018 | Mazyar et al. | |
| 9,982,505 | B2 | 5/2018 | Rytlewski et al. | |
| 10,125,565 | B2 | 11/2018 | Fripp et al. | |
| 10,156,118 | B2 | 12/2018 | Fripp et al. | |
| 10,260,306 | B1 | 4/2019 | Beckett et al. | |
| 10,465,468 | B2 | 11/2019 | Frazier et al. | |
| 10,605,043 | B2 | 3/2020 | Zbranek et al. | |
| 10,648,272 | B2 | 5/2020 | Budde et al. | |
| 10,871,052 | B2 | 12/2020 | Gano et al. | |
| 11,066,900 | B2 | 7/2021 | Lende et al. | |
| 11,105,166 | B2 | 8/2021 | Yuan et al. | |
| 11,293,252 | B2 | 4/2022 | Lewis et al. | |
| 11,359,454 | B2 | 6/2022 | Helms et al. | |
| 11,613,959 | B1 | 3/2023 | McFarlin | |
| 2011/0042099 | A1 | 2/2011 | Williamson, Jr. et al. | |
| 2014/0216756 | A1* | 8/2014 | Getzlaf | E21B 7/20 166/376 |
| 2014/0338925 | A1 | 11/2014 | Warlick et al. | |
| 2018/0045014 | A1 | 2/2018 | Larisey | |
| 2020/0131884 | A1* | 4/2020 | Saraya | E21B 34/06 |
| 2020/0173252 | A1* | 6/2020 | Lende | E21B 33/16 |
| 2021/0222507 | A1 | 7/2021 | Vick, Jr. | |
| 2022/0228461 | A1* | 7/2022 | Sims | E21B 34/063 |

* cited by examiner

WIPER PLUG WITH DISSOLVABLE CORE

BACKGROUND

Field

Aspects of the present disclosure relate to wellbore plugs, and specifically to pump down wiper plug assemblies used for conducting casing integrity pressure tests and completing wellbores.

Description of the Related Art

Once a wellbore has been drilled, additional steps must be taken to complete the wellbore. For example, a casing string (e.g. large tubular members) is lowered and cemented into the wellbore. When cemented in place, a casing integrity pressure test is conducted to ensure that the casing can safely withstand operating pressures without failure. Fluid flow through the lower end of the casing string must be closed to conduct the pressure test, and then fluid flow through the lower end of the casing string must be re-opened to allow for completion of the wellbore. Current methods of conducting the pressure test, as well as closing and re-opening fluid flow through the lower end of the casing string, are time consuming and require additional tools.

Therefore, there is a need for new and/or improved apparatus and methods for conducting casing integrity pressure tests and completing wellbores.

SUMMARY

In one embodiment, a plug assembly comprises a mandrel having an inner bore; a wiper coupled to an outer surface of the mandrel; a rupture disk coupled to the mandrel and configured to temporarily close fluid flow through the inner bore of the mandrel; and a dissolvable member coupled to the mandrel and configured to temporarily close fluid flow through the inner bore of the mandrel, wherein the dissolvable member is positioned below the rupture disk, and wherein a bottom surface of the dissolvable member comprises a protective coating.

In one embodiment, a plug assembly comprises a mandrel having an inner bore; a wiper coupled to an outer surface of the mandrel; a first rupture disk coupled to the mandrel and configured to temporarily close fluid flow through the inner bore of the mandrel; a dissolvable member coupled to the mandrel and configured to temporarily close fluid flow through the inner bore of the mandrel, wherein the dissolvable member is positioned below the first rupture disk; and a second rupture disk coupled to the mandrel and configured to temporarily close fluid flow through the inner bore of the mandrel, wherein the dissolvable member is positioned above the second rupture disk.

In one embodiment, a plug assembly comprises a mandrel having an inner bore; a wiper coupled to an outer surface of the mandrel; a dissolvable member disposed through a sidewall of the mandrel and configured to temporarily close fluid flow through the inner bore of the mandrel; and a sleeve coupled to the mandrel, wherein the sleeve is moveable from a first position, where a non-coated portion of the dissolvable member is not exposed to fluids that dissolve the dissolvable member, to a second position, where the non-coated portion of the dissolvable member is exposed to fluid that dissolve the dissolvable member.

BRIEF DESCRIPTION OF THE DRAWINGS

So that the manner in which the above-recited features of the disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

The disclosure contemplates that terms such as "couples," "coupling," "couple," and "coupled" may include but are not limited to welding, interference fitting, and/or fastening such as by using bolts, threaded connections, pins, and/or screws. The disclosure contemplates that terms such as "couples," "coupling," "couple," and "coupled" may include but are not limited to integrally forming. The disclosure contemplates that terms such as "couples," "coupling," "couple," and "coupled" may include but are not limited to direct coupling and/or indirect coupling, such as indirect coupling through components such as links.

Figure 1:
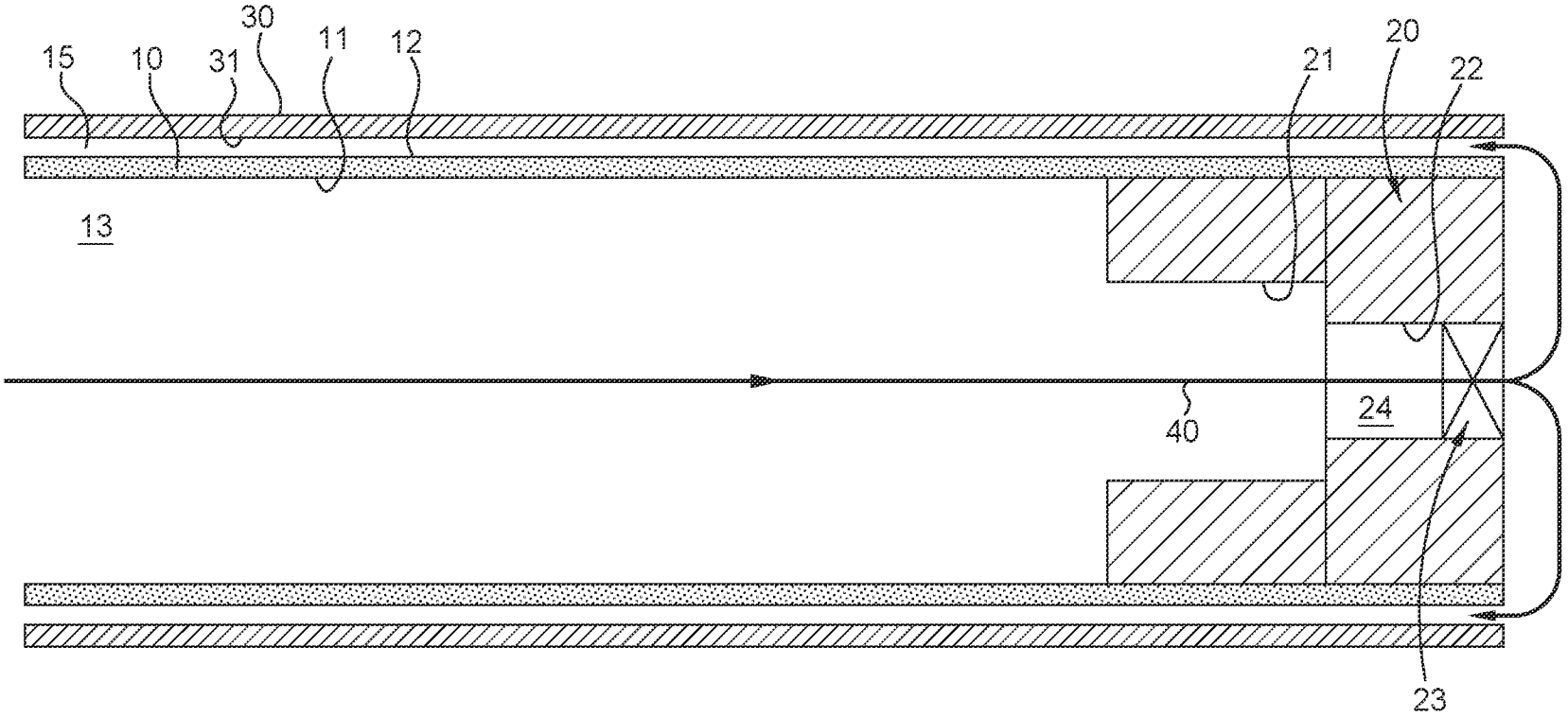
FIG. 1 is a sectional view of a casing string in a wellbore, according to one embodiment.

FIG. 1 is a sectional view of a casing string 10 in a wellbore 30, according to one embodiment. The casing string 10 comprises one or more tubular members coupled together. The casing string 10 has an outer surface 12 and an inner surface 11 that forms an inner bore 13. A casing shoe 20, also referred to as a wet shoe or a float shoe, is coupled to the lower end of the casing string 10. The casing shoe 20 comprises a plug seat 21 and a check valve 23 disposed in an inner bore 24 of the casing shoe 20. The inner bore 24 may have an inner diameter 22 that is less than an inner diameter of the plug seat 21.

As the casing string 10 is being lowered and/or once the casing string 10 is lowered into the desired location in the wellbore 30, a cementing operation is conducted to cement the casing sting 10 in the wellbore 30. Cement 40 is pumped down through the inner bore 13 of the casing string 10 until it flows out through the lower end of the casing string 10. Specifically, the cement 40 flows out through the check valve 23 of the casing shoe 20. The check valve 23 allows fluid flow out through the lower end of the casing string 10 and prevents fluid flow back into the inner bore 13 of the casing string 10. The cement 40 flows out into the wellbore 30 and flows up though an annulus 15 formed between the outer surface 12 of the casing string 10 and an inner surface 31 of the wellbore 30.

After completion of the cementing operation, a casing integrity pressure test is conducted to ensure that the casing string 10 can safely withstand operating pressures without failure. One such type of operating pressure may be when conducting a fracing operation to fracture the wellbore 10 and a highly pressurized fluid is supplied through the casing string 10 into the wellbore 10. The casing string 10 must be able to safely contain and direct the highly pressurized fluid without failure.

To conduct the casing integrity pressure test, fluid flow through the lower end of the casing string 10 must be closed. After completing the casing integrity pressure test, fluid flow through the lower end of the casing string 10 must be re-opened. The plug assemblies 100 as described herein can be used to close and re-open fluid flow through the lower end of the casing string 10.

Figure 2:
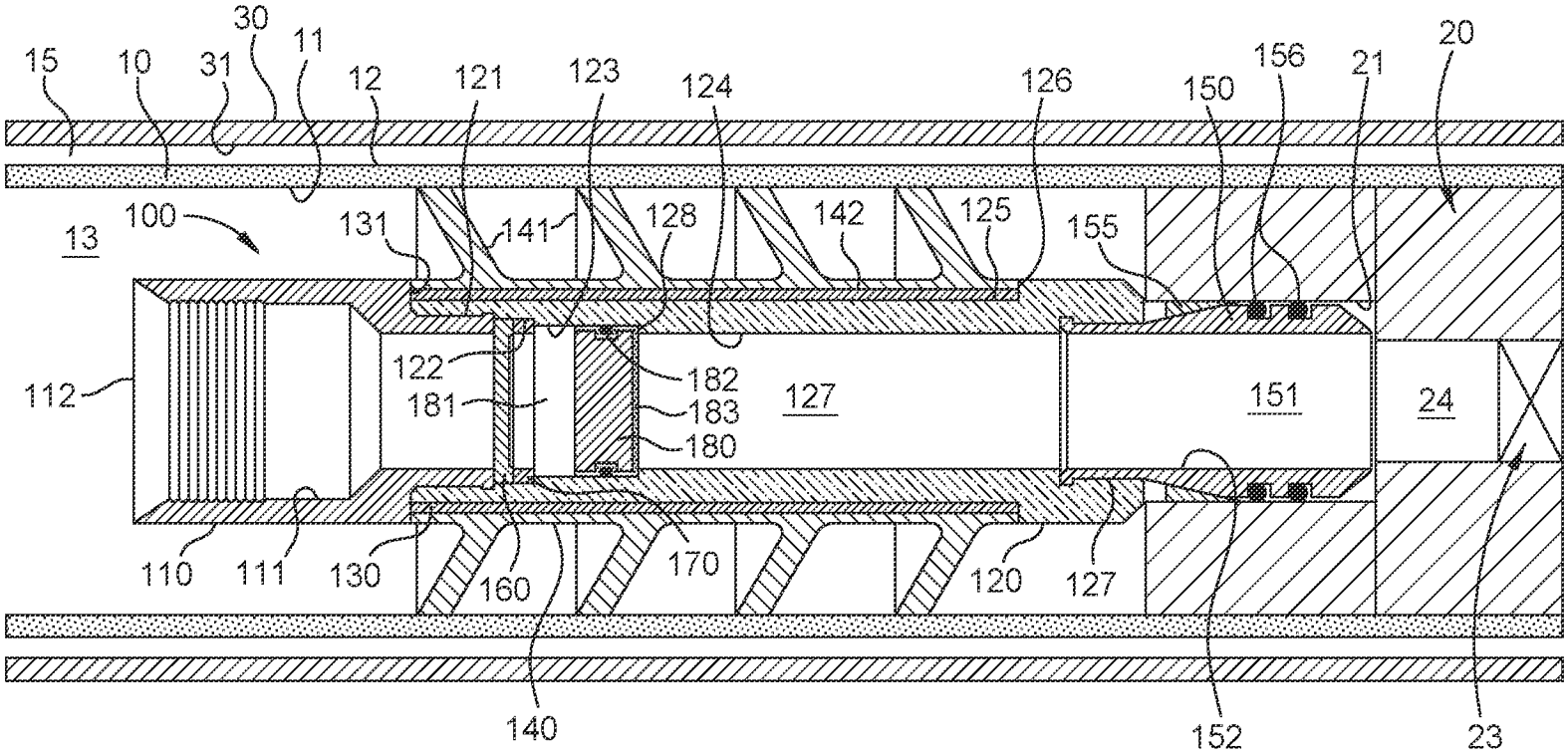
FIG. 2 is a sectional view of a plug assembly disposed in the casing string, according to one embodiment.

FIG. 2 is a sectional view of a plug assembly 100 disposed in the casing string 10, according to one embodiment. The plug assembly 100 is pumped down through the casing string 10 at the end of the supply of cement 40 or sometime after. The plug assembly 100 comprises an upper mandrel 110, a middle mandrel 120, and a lower mandrel 150. An inner surface 111 of the upper mandrel 110 forms an inner bore 112. An inner surface 124 of the middle mandrel 120 forms an inner bore 127. An inner surface 152 of the lower mandrel 150 forms an inner bore 151.

The lower end of the upper mandrel 110 may be coupled to the upper end of the middle mandrel 120 via a connection 121, which may be a threaded connection. Similarly, the lower end of the middle mandrel 120 may be coupled to the upper end of the lower mandrel 150 via a connection 127, which may be a threaded connection. Although the upper, middle, and lower mandrels 110, 120, 150 are illustrated as being solid, single-piece tubular members, the upper, middle, and/or lower mandrel 110, 120, 150 may be formed out of one or more tubular members and/or other components that are coupled together. Similarly, the upper, middle, and/or lower mandrel 110, 120, 150 may be integrally formed with any one or both of the other mandrels.

The lower mandrel 150 further comprises one or more gripping members 155, such as slips, and one or more sealing members 156, such as O-rings. The lower mandrel 150 is sized to land in and engage the plug seat 21 of the casing shoe 20. When the plug assembly 100 is pumped down the casing string 10 and engages the plug seat 21, the gripping members 155 grip against the inner surface of the plug seat 21, and the sealing members 156 seal against the inner surface of the plug seat 21. When the lower mandrel 150 is engaged with the plug seat 21, the inner bore 151 of the lower mandrel 150 is in fluid communication with the inner bore 24 of the casing shoe 20.

The plug assembly 100 further comprises an inner sleeve 130 coupled to an outer surface 125 of the middle mandrel 120, and a wiper 140 coupled to an outer surface 142 of the inner sleeve 130. The inner sleeve 130 and the wiper 140 may be coupled between an outer shoulder 126 of the middle mandrel 120 and an outer shoulder 131 of the upper mandrel 110. The wiper 140 comprises one or more fins 141 in the form of cup-shaped seals configured to seal against the inner surface 11 of the casing string 10. The fins 141 push any fluids, such as the cement 40, down through the inner bore 13 of the casing string 10 and out through the casing shoe 20. The fins 141 may prevent fluids from flowing past the outside of the wiper 140.

The plug assembly 100 further comprises a rupture disk 160, a spacer ring 170, and a dissolvable member 180 disposed within and coupled to the middle mandrel 120. The dissolvable member 180 and the rupture disk 160 are configured to temporarily close fluid flow through the plug assembly 100 as further described below. The rupture disk 160 is located adjacent to the spacer ring 170, each of which are located within an inner diameter area 122 of the middle mandrel 120. A bottom end of the upper mandrel 110 may abut against a top end of the rupture disk 160 to secure the rupture disk 160 in place. The dissolvable member 180 is located below the rupture disk 160 and the spacer ring 170 within an inner diameter area 123 of the middle mandrel 120. The dissolvable member 180 abuts an inner shoulder 128 of the middle mandrel 120. The dissolvable member 180 may be formed out of a material that begins to dissolve when in contact with a fluid. The dissolvable member 180 may be formed out of magnesium alloys, aluminum alloys, water soluble composites, water soluble plastics, and/or combinations thereof.

The dissolvable member 180 is movable along and relative to the inner diameter area 123 of the middle mandrel 120 between the spacer ring 170 and the inner shoulder 128. One or more sealing members 182, such as O-rings, may be coupled to the dissolvable member 180 to form a seal between the outer surface of the dissolvable member 180 and the inner diameter area 123 of the middle mandrel 120. The dissolvable member 180 is movable to act as a balance piston, thereby preventing a pressure trap and/or removing any effects caused by hydrostatic pressure as the plug assembly 100 is pumped down the casing string 10. In an alternative embodiment, the dissolvable member 180 is fixed to the inner diameter area 123 of the middle mandrel 120 and is not movable.

The dissolvable member 180 further comprises a coating 183 formed on at least the bottom surface. The coating 183 may also be applied to the side and top surfaces as well. The coating 183 prevents the dissolvable member 180 from dissolving until the desired time. A non-reactive fluid 181 is disposed within the area of the inner bore 127 formed between the rupture disk 160 and the top surface of the dissolvable member 180. The non-reactive fluid 181 does not react with the dissolvable member 180, and similarly prevents the dissolvable member 180 from dissolving until the desired time. The non-reactive fluid 181 may be water, oil, hydrocarbons, high pH fluids (e.g. fluids that have a low acidity), and/or combinations thereof.

The plug assembly 100 lands onto and/or into the plug seat 21 of the casing shoe 20 and closes fluid flow through the lower end of the casing string 10. The sealing members 156 seal against the plug seat 21, and the fins 141 seal against the inner surface 11 of the casing string 10. In addition, the rupture disk 160 prevents fluid flow through the inner bore 127 of the middle mandrel 120. A sudden pressure increase within the casing string 10 above the plug assembly 100 provides an indication that plug assembly 100 has reached and sealed against the plug seat 21 of the casing shoe 20, and that the cement 40 has been pushed through the casing string 10.

A casing integrity pressure test may now begin when the plug assembly 100 engages the plug seat 21. The burst pressure of the rupture disk 160 is set at a pressure less than the casing integrity pressure of the casing string 10. When the casing integrity pressure test begins, the pressure within the casing string 10 above the rupture disk 160 is increased until the rupture disk 160 ruptures. The dissolvable member 180 (if not already fixed in place) is moved into a position against the inner shoulder 128. The dissolvable member 180 then holds the pressure within the casing string 10 and at the same time is exposed to the fluids within the inner bore 13 of the casing string 10 above the plug assembly 100. The dissolvable member 180 is configured to hold the pressure in the casing string 10 at or greater than the casing integrity pressure, and for an amount of time sufficient to complete the casing integrity pressure test, all before the fluids begin to dissolve the dissolvable member 180 to a point where the dissolvable member 180 cannot hold the casing integrity pressure.

After the casing integrity pressure test is complete, fluid flow through the lower end of the casing string 10 is re-opened when the dissolvable member 180 sufficiently dissolves. Specifically, fluids can flow through the inner bores 112, 127, 151 of the upper, middle, lower mandrels 110, 120, 130 of the plug assembly 100 to the inner bore 24 of the casing shoe 20, and then out of the lower end of the casing string 10 through the check valve 23 of the casing shoe 20.

Figure 3:
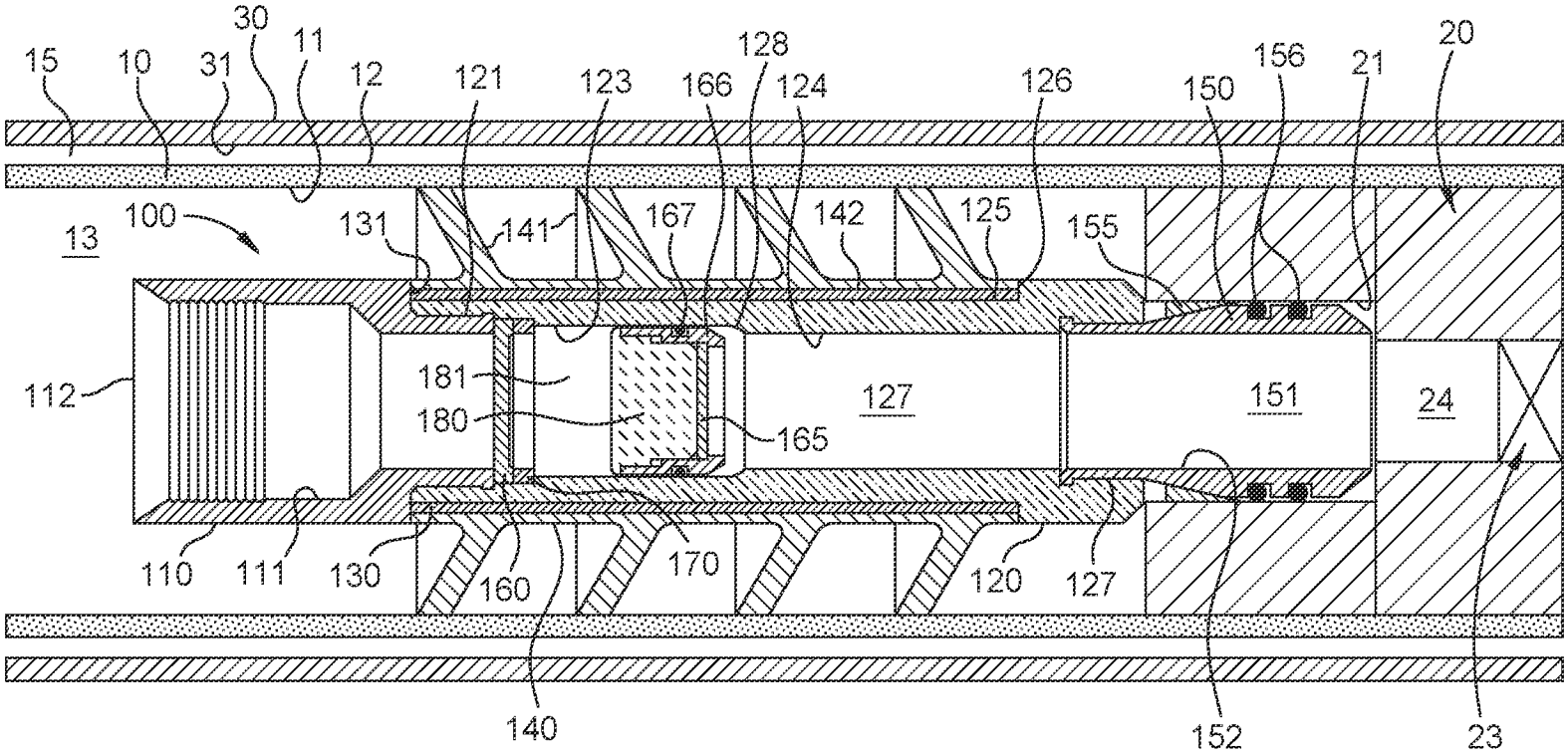
FIG. 3 is a sectional view of a plug assembly disposed in the casing string, according to one embodiment.

FIG. 3 is a sectional view of another plug assembly 100 disposed in the casing string 10, according to one embodiment. The plug assembly 100 illustrated in FIG. 3 is similar to the plug assembly 100 illustrated in FIG. 2, however, one difference is that a second rupture disk 165 is used and placed adjacent to or below the dissolvable member 180 instead of using the coating 183. The dissolvable member 180 and the second rupture disk 165 are coupled to a support sleeve 166, which may be movable along (or alternatively may be fixed to) the inner diameter area 123 of the second mandrel 120. One or more sealing members 167, such as O-rings, may be coupled to the support sleeve 166 to form a seal between the outer surface of the support sleeve 166 and the inner diameter area 123 of the middle mandrel 120.

When the casing integrity pressure test begins, the pressure within the casing string 10 above the rupture disk 160 is increased until the rupture disk 160 ruptures. The dissolvable member 180 then holds the pressure within the casing string 10 and at the same time is exposed to the fluids within the inner bore 13 of the casing string 10 above the plug assembly 100. The dissolvable member 180, the support sleeve 166, and the second rupture disk 165 (if not already fixed in place) are moved into a position against the inner shoulder 128 by the pressure above the dissolvable member 180. The dissolvable member 180 is configured to hold the pressure in the casing string 10 at or greater than the casing integrity pressure, and for an amount of time sufficient to complete the casing integrity pressure test, all before the fluids begin to dissolve the dissolvable member 180 to a point where the dissolvable member 180 cannot hold the casing integrity pressure.

After the casing integrity pressure test is complete, and after the dissolvable member 180 sufficiently dissolves, the pressure within the casing string 10 can be increased (or can already be at a pressure sufficient) to rupture the second rupture disk 165. The second rupture disk 165 has a rupture pressure lower than the casing integrity pressure, and is provided to protect the dissolvable member 180 from fluids below the dissolvable member 180 until at least the casing integrity pressure test begins. Fluid flow through the lower end of the casing string 10 is re-opened when the dissolvable member 180 sufficiently dissolves and the second rupture disk 165 ruptures. Specifically, fluids can flow through the inner bores 112, 127, 151 of the upper, middle, lower mandrels 110, 120, 130 of the plug assembly 100 to the inner bore 24 of the casing shoe 20, and then out of the lower end of the casing string 10 through the check valve 23 of the casing shoe 20.

Figure 4:
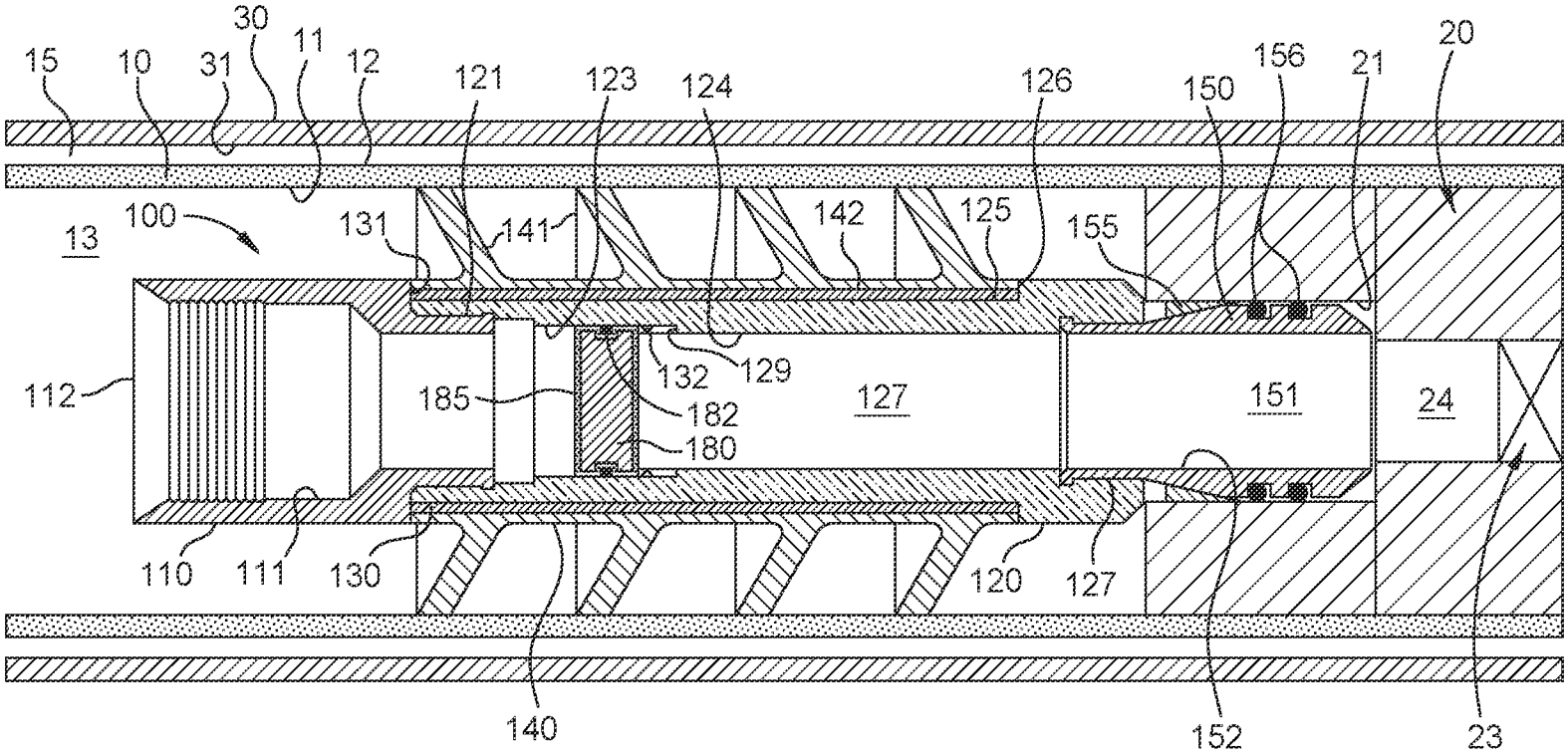
FIG. 4 is a sectional view of a plug assembly disposed in the casing string, according to one embodiment.

FIG. 4 is a sectional view of another plug assembly 100 disposed in the casing string 10, according to one embodiment. The plug assembly 100 illustrated in FIG. 4 is similar to the plug assembly 100 illustrated in FIG. 2, however, one difference is that there are no rupture disks or spacer rings used, and the entire outer surface of the dissolvable member 180 has a coating 185 (similar to coating 183). The coating 185 prevents the dissolvable member 180 from being exposed to a fluid that begins dissolving the dissolvable member 180 until the desired time.

Pressure applied to the dissolvable member 180 from above may force the dissolvable member 180 to at least partially shear a shearable member 132 and allow the dissolvable member 180 to move against an inner shoulder 129 of the middle mandrel 120. The coating 185 may be scratched or scored by the shearable member 132, which may be a shear screw or shear pin coupled to the inner surface of the middle mandrel 120, to expose the dissolvable member 180 to fluids that will begin to dissolve the dissolvable member 180. Alternatively, the shearable member 132 may be a jagged or roughened portion of the inner surface of the middle mandrel 120 that scratches or scores the coating 185 to expose the dissolvable member 180 when the dissolvable member 180 is moved across the jagged or roughened portion and into contact with the inner shoulder 129. The dissolvable member 180 will still be able to hold the pressure above to conduct the casing pressure integrity test before completely dissolving.

Figure 5A:
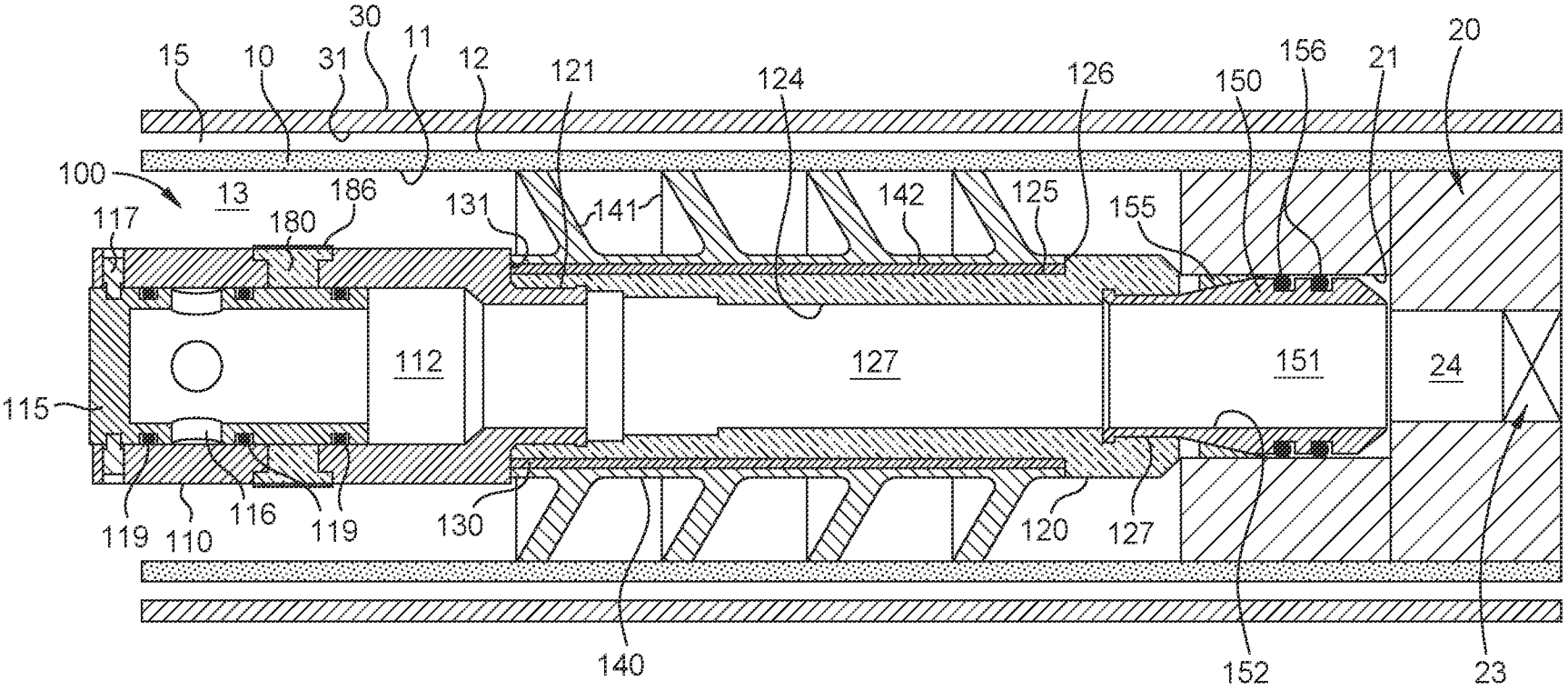
FIG. 5A is a sectional view of a plug assembly, in a first position, disposed in the casing string, according to one embodiment.
Figure 5B:
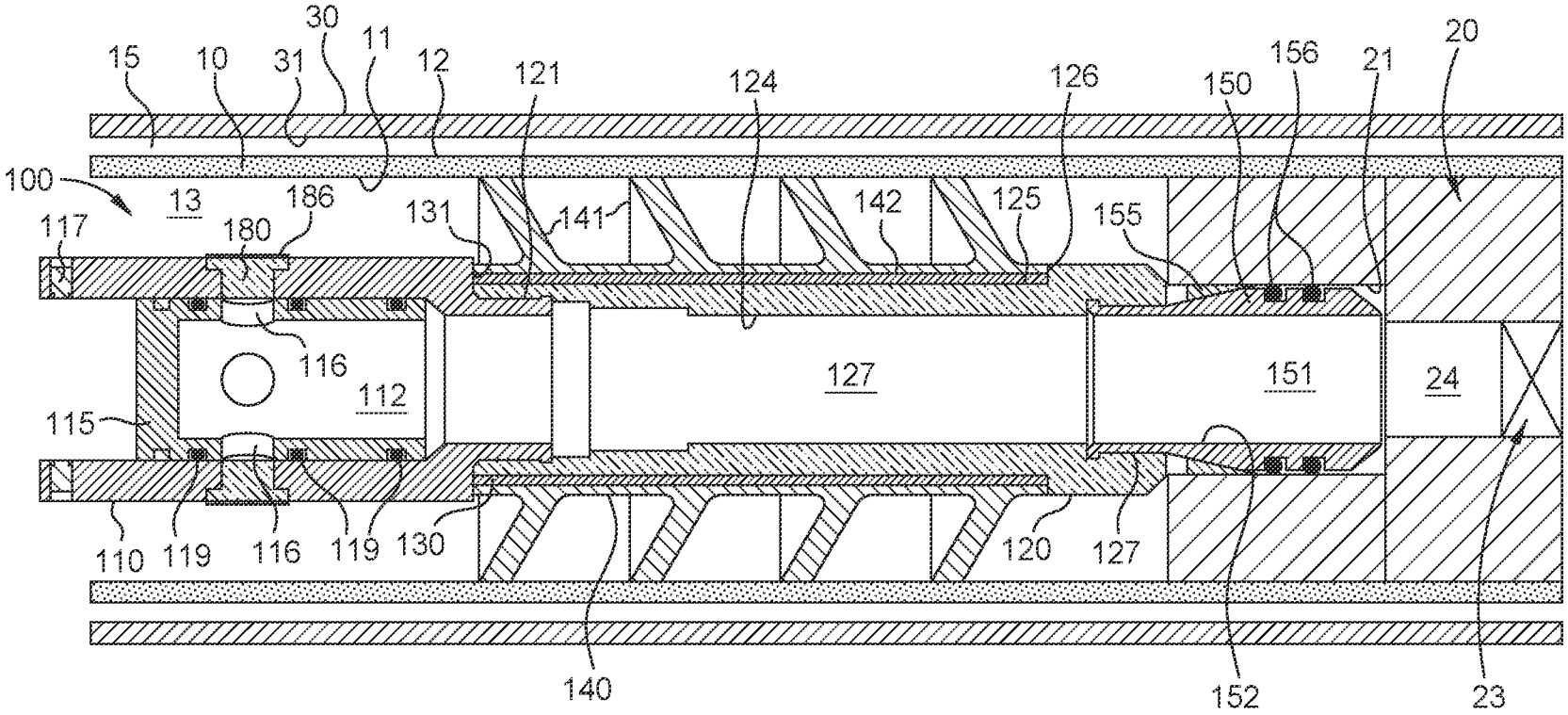
FIG. 5B is a sectional view of the plug assembly, in a second position, disposed in the casing string, according to one embodiment.

FIGS. 5A and 5B are sectional views of another plug assembly 100 disposed in the casing string 10, according to one embodiment. The plug assembly 100 illustrated in FIGS. 5A and 5B is similar to the plug assembly 100 illustrated in FIG. 2, however, one difference is that there are no rupture disks or spacer rings used, and the dissolvable member 180 has been moved to a position within the sidewall of the upper mandrel 110. Another difference is the addition of an internal sleeve 115 that is coupled to the inner surface of the upper mandrel 110 by one or more releasable members 117, such as shear screws or pins.

One or more sealing members 119, such as O-rings, are positioned between the outer surface of the internal sleeve 115 and the inner surface of the upper mandrel 110. A port 116 is disposed through the sidewall of the internal sleeve 115. The dissolvable member 180 extends through the sidewall of the upper mandrel 110. The outer surface of the dissolvable member 180, which may be flush with and/or closest to the outer surface of the upper mandrel 110, has a coating 186 (similar to coatings 185, 183). The coating 186 prevents the outer surface of the dissolvable member 180 from dissolving until the desired time. The inner surface of the dissolvable member 180, which may be flush with and/or closest to the inner surface of the upper mandrel 110, is located between two of the sealing members 119 of the internal sleeve 115. The sealing members 119 prevent fluids from contacting the non-coated portion of the dissolvable member 180 until the desired time.

As shown in FIG. 5A, the internal sleeve 115 is secured in a first position, such as a run-in position, by the one or more releasable members 117, as the plug assembly 100 is lowered and/or pumped into engagement with the plug seat 21 of the casing shoe 20. The releasable members 117 are set to shear at a pressure less than the casing integrity pressure.

As shown in FIG. 5B, when the casing integrity pressure test begins, the pressure within the casing string 10 above the plug assembly 100 is increased until the releasable members 117 shear and the internal sleeve 115 moves from the first position to a second position, such as a pressure test position, and into engagement with an inner shoulder of the upper mandrel 110. When in the second position, the port 116 of the internal sleeve 115 aligns with the dissolvable member 180, thereby exposing the non-coated portion of the dissolvable member 180 to fluids located within the inner bores 112, 127, 151 of the upper, middle, lower mandrels 110, 120, 130 of the plug assembly 100.

The dissolvable member 180 then holds the pressure within the casing string 10. The dissolvable member 180 is configured to hold the pressure in the casing string 10 at or greater than the casing integrity pressure, and for an amount of time sufficient to complete the casing integrity pressure test, before the fluids begin to dissolve the dissolvable member 180 to a point where the dissolvable member 180 cannot hold the casing integrity pressure.

After the casing integrity pressure test is complete, fluid flow through the lower end of the casing string 10 is re-opened when the dissolvable member 180 sufficiently dissolves. Specifically, fluids can flow through the sidewall of the upper mandrel 110 where the dissolvable member 180 was located, through the port 116 of the internal sleeve 115, through the inner bores 112, 127, 151 of the upper, middle, lower mandrels 110, 120, 130 to the inner bore 24 of the casing shoe 20, and then out of the lower end of the casing string 10 through the check valve 23 of the casing shoe 20.

Figure 6A:
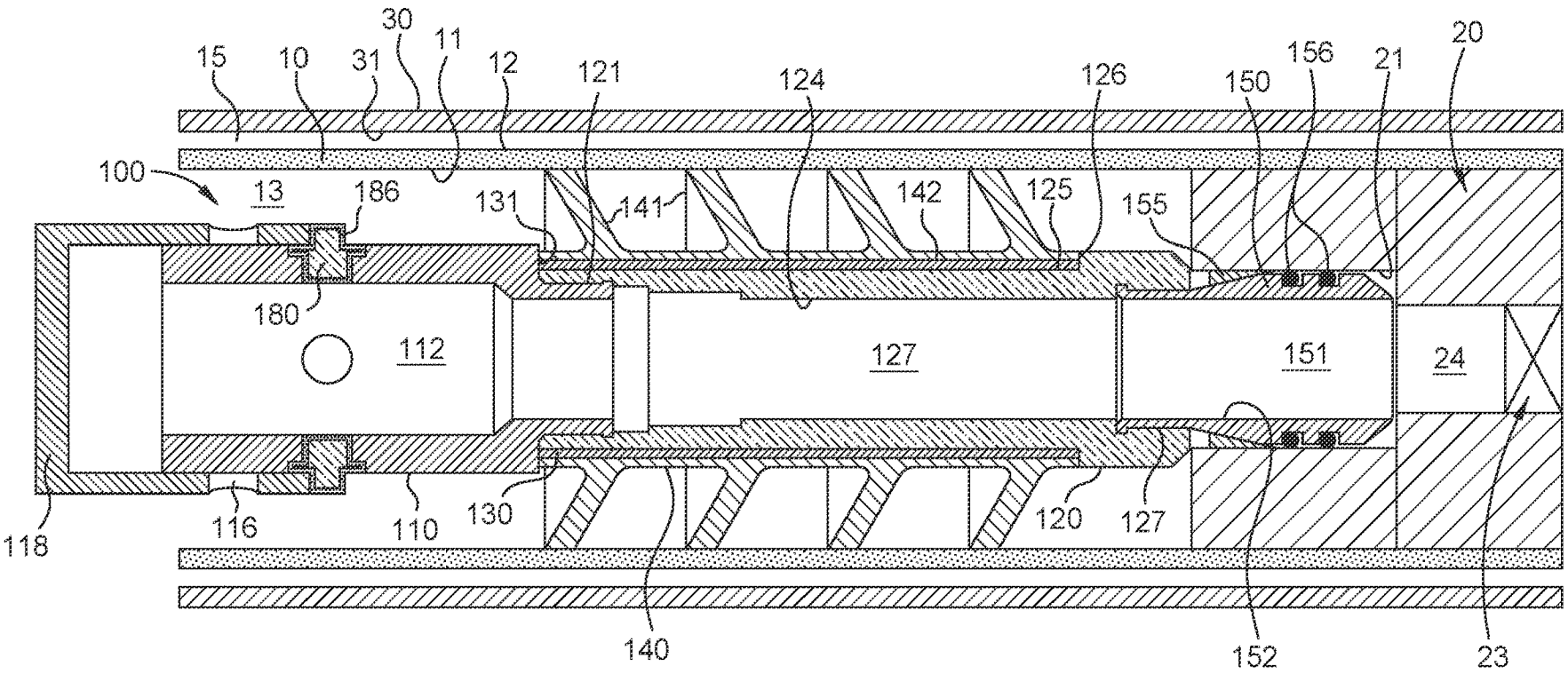
FIG. 6A is a sectional view of a plug assembly, in a first position, disposed in the casing string, according to one embodiment.
Figure 6B:
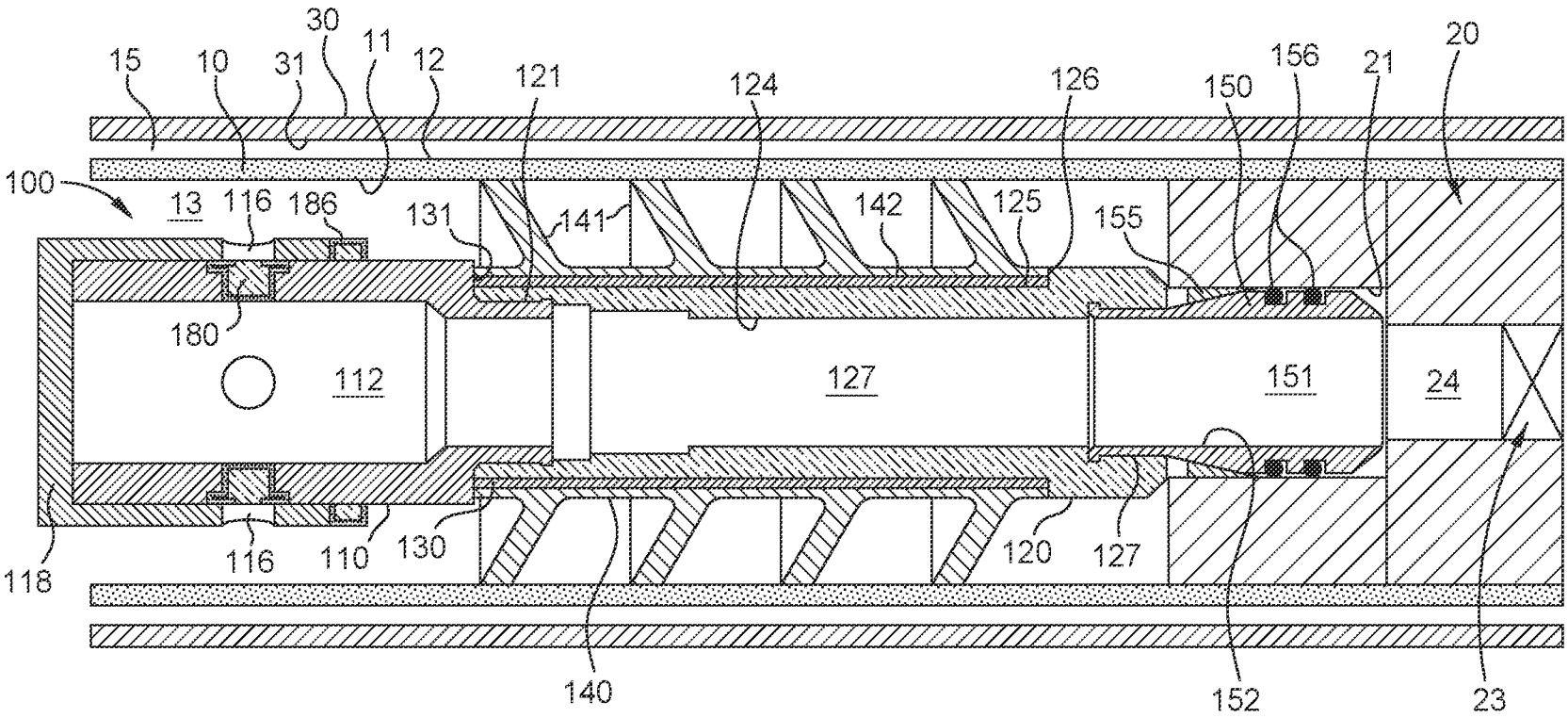
FIG. 6B is a sectional view of the plug assembly, in a second position, disposed in the casing string, according to one embodiment.

FIGS. 6A and 6B are sectional views of another plug assembly 100 disposed in the casing string 10, according to one embodiment. The plug assembly 100 illustrated in FIGS. 6A and 6B is similar to the plug assembly 100 illustrated in FIG. 2, however, one difference is that there are no rupture disks or spacer rings used, and the dissolvable member 180 has been moved to a position within the sidewall of the upper mandrel 110. Another difference is the addition of an external sleeve 115 that is coupled to the outer surface of the upper mandrel 110 (such as by an interference fit) and abuts a portion of the dissolvable member 180 that extends out of the sidewall of the upper mandrel 110. Another difference is that the entire outer surface of the dissolvable member 180 is covered with a coating 186 (similar to coatings 183, 185). The coating 186 prevents the dissolvable member 180 from dissolving until the desired time.

A port 116 is disposed through the sidewall of the external sleeve 118. The dissolvable member 180 extends through the sidewall of the upper mandrel 110. The outer surface of the dissolvable member 180 may extend above or outward of the outer surface of the upper mandrel 110. The inner surface of the dissolvable member 180 may be flush with the inner surface of the upper mandrel 110.

As shown in FIG. 6A, the external sleeve 118 is secured in a first position, such as a run-in position, by the dissolvable member 180 as the plug assembly 100 is lowered and/or pumped into engagement with the plug seat 21 of the casing shoe 20. In addition to or alternatively, the external sleeve 118 may be secured in the first position by one or more releasable members, such as releasable members 117 shown in FIGS. 5A and 5B, which are set to shear at a pressure less than the casing integrity pressure.

As shown in FIG. 6B, when the casing integrity pressure test begins, the pressure within the casing string 10 above the plug assembly 100 is increased until the external sleeve 118 shears the portion of the dissolvable member 180 which extended from the sidewall of the upper mandrel 110. The external sleeve 118 moves from the first position to a second position, such as a pressure test position, and into engagement with the top end or an upper shoulder of the upper mandrel 110. When in the second position, the port 116 of the external sleeve 118 aligns with the sheared portion of the dissolvable member 180, thereby exposing the internal, non-coated portion of the dissolvable member 180 to fluids located within the inner bore 13 of the casing string 10.

The dissolvable member 180 then holds the pressure within the casing string 10. The dissolvable member 180 is configured to hold the pressure in the casing string 10 at or greater than the casing integrity pressure, and for an amount of time sufficient to complete the casing integrity pressure test, before the fluids begin to dissolve the dissolvable member 180 to a point where the dissolvable member 180 cannot hold the casing integrity pressure.

After the casing integrity pressure test is complete, fluid flow through the lower end of the casing string 10 is re-opened when the dissolvable member 180 sufficiently dissolves. Specifically, fluids can flow through the port 116 of the external sleeve 118, through the sidewall of the upper mandrel 110 where the dissolvable member 180 was located, through the inner bores 112, 127, 151 of the upper, middle, lower mandrels 110, 120, 130 to the inner bore 24 of the casing shoe 20, and then out of the lower end of the casing string 10 through the check valve 23 of the casing shoe 20.

Any one or more components of the plug assemblies 100 may be integrally formed together, directly coupled together, and/or indirectly coupled together, and are not limited to the specific arrangement of components illustrated in the Figures.

It will be appreciated by those skilled in the art that the preceding embodiments are exemplary and not limiting. It is intended that all modifications, permutations, enhancements, equivalents, and improvements thereto that are apparent to those skilled in the art upon a reading of the specification and a study of the drawings are included within the scope of the disclosure. It is therefore intended that the following appended claims may include all such modifications, permutations, enhancements, equivalents, and improvements. The disclosure also contemplates that one or more aspects of the embodiments described herein may be substituted in for one or more of the other aspects described. The scope of the disclosure is determined by the claims that follow.

We claim:

1. A plug assembly, comprising:

a mandrel having an inner bore; a wiper coupled to an outer surface of the mandrel;

a rupture disk coupled to the mandrel and configured to temporarily close fluid flow through the inner bore of the mandrel; and a dissolvable member coupled to the mandrel and configured to temporarily close fluid flow through the inner bore of the mandrel, wherein:

the dissolvable member is positioned below the rupture disk;

an area between the rupture disk and the dissolvable member is filled with a non-reactive fluid that does not react with the dissolvable member, wherein the non-reactive fluid comprises at least one of water, oil, hydrocarbons, high pH fluids, and combinations thereof; and a bottom surface of the dissolvable member comprises a protective coating.

2. The plug assembly of claim 1, wherein a spacer ring is positioned adjacent to the rupture disk.

3. The plug assembly of claim 1, wherein the dissolvable member is movable relative to the mandrel.

4. The plug assembly of claim 1, wherein the dissolvable member comprises at least one of magnesium alloys, aluminum alloys, water soluble composites, water soluble plastics, and combinations thereof.

5. The plug assembly of claim 1, wherein the wiper comprises one or more fins in the form of cup-shaped seals, wherein the mandrel comprises an upper mandrel and a lower mandrel coupled at opposite ends to a middle mandrel, and wherein one or more gripping members and one or more sealing member are coupled to an outer surface of the lower mandrel.

6. The plug assembly of claim 1, further comprising one or more sealing members coupled to the dissolvable member to seal between the dissolvable member and the mandrel.

7. The plug assembly of claim 1, further comprising an inner sleeve disposed between the outer surface of the mandrel and the wiper.

8. The plug assembly of claim 1, wherein one or more of a top surface and a side surface of the dissolvable member comprise the protective coating.

9. A plug assembly, comprising:

a mandrel having an inner bore;

a wiper coupled to an outer surface of the mandrel;

a first rupture disk coupled to the mandrel and configured to temporarily close fluid flow through the inner bore of the mandrel;

a dissolvable member coupled to the mandrel and configured to temporarily close fluid flow through the inner bore of the mandrel, wherein the dissolvable member is positioned below the first rupture disk, wherein an area between the first rupture disk and the dissolvable member is filled with a non-reactive fluid that does not react with the dissolvable member, and wherein the non-reactive fluid comprises at least one of water, oil, hydrocarbons, high pH fluids, and combinations thereof; and a second rupture disk coupled to the mandrel and configured to temporarily close fluid flow through the inner bore of the mandrel, wherein the dissolvable member is positioned above the second rupture disk.

10. The plug assembly of claim 9, wherein a spacer ring is positioned adjacent to the first rupture disk.

11. The plug assembly of claim 9, wherein the dissolvable member and the second rupture disk are coupled to a support sleeve, and wherein the dissolvable member, the second rupture disk, and the support sleeve movable relative to the mandrel.

12. The plug assembly of claim 11, further comprising one or more sealing members coupled to the support sleeve to seal between the support sleeve and the mandrel.

13. The plug assembly of claim 11, wherein the support sleeve is movable to abut an inner shoulder of the mandrel.

14. The plug assembly of claim 9, wherein the dissolvable member comprises at least one of magnesium alloys, aluminum alloys, water soluble composites, water soluble plastics, and combinations thereof.

15. The plug assembly of claim 9, wherein the wiper comprises one or more fins in the form of cup-shaped seals, wherein the mandrel comprises an upper mandrel and a lower mandrel coupled at opposite ends to a middle mandrel, and wherein one or more gripping members and one or more sealing member are coupled to an outer surface of the lower mandrel.

16. The plug assembly of claim 9, further comprising an inner sleeve disposed between the outer surface of the mandrel and the wiper.

17. A plug assembly, comprising:

a mandrel having an inner bore;

a wiper coupled to an outer surface of the mandrel;

a first rupture disk coupled to the mandrel and configured to temporarily close fluid flow through the inner bore of the mandrel;

a dissolvable member coupled to the mandrel and configured to temporarily close fluid flow through the inner bore of the mandrel, wherein the dissolvable member is positioned below the first rupture disk;

a second rupture disk coupled to the mandrel and configured to temporarily close fluid flow through the inner bore of the mandrel, wherein the dissolvable member is positioned above the second rupture disk; and a support sleeve, wherein the dissolvable member and the second rupture disk are coupled to the support sleeve, and wherein the dissolvable member, the second rupture disk, and the support sleeve are movable relative to the mandrel.

18. The plug assembly of claim 17, wherein an area between the first rupture disk and the dissolvable member is filled with a non-reactive fluid that does not react with the dissolvable member, and wherein the non-reactive fluid comprises at least one of water, oil, hydrocarbons, high pH fluids, and combinations thereof.

19. The plug assembly of claim 17, wherein the dissolvable member comprises at least one of magnesium alloys, aluminum alloys, water soluble composites, water soluble plastics, and combinations thereof.

20. The plug assembly of claim 17, wherein the wiper comprises one or more fins in the form of cup-shaped seals, wherein the mandrel comprises an upper mandrel and a lower mandrel coupled at opposite ends to a middle mandrel, and wherein one or more gripping members and one or more sealing member are coupled to an outer surface of the lower mandrel.

* * * * *